US006865768B2

(12) United States Patent
Chen

(10) Patent No.: US 6,865,768 B2
(45) Date of Patent: Mar. 15, 2005

(54) SPONGE MOP ASSEMBLY

(75) Inventor: Hwa-Tien Chen, Taichung Hsien (TW)

(73) Assignee: Chin-Ting Cheng (TW)

( * ) Notice: Subject to any disclaimer, the term of this patent is extended or adjusted under 35 U.S.C. 154(b) by 2 days.

(21) Appl. No.: 10/270,532

(22) Filed: Oct. 16, 2002

(65) Prior Publication Data

US 2004/0074032 A1 Apr. 22, 2004

(51) Int. Cl.[7] ..... A47L 13/12; A47L 13/144
(52) U.S. Cl. ..... 15/115; 15/116.2; 15/119.2
(58) Field of Search ..... 15/115, 118, 116.1, 15/116.2, 119.1, 119.2

(56) References Cited

U.S. PATENT DOCUMENTS 4,491,998 A * 1/1985 Wilson et al. ..... 15/119.2
4,604,767 A * 8/1986 Burkhart et al. ..... 15/119.2
4,654,920 A * 4/1987 O'Neil et al. ..... 15/119.2
5,655,248 A * 8/1997 Kieson et al. ..... 15/119.2
6,000,087 A * 12/1999 Petner ..... 15/119.2
6,061,863 A * 5/2000 Chen ..... 15/119.2
6,178,581 B1 * 1/2001 Lewis ..... 15/116.2
6,389,635 B1 * 5/2002 Petner et al. ..... 15/119.2

* cited by examiner

*Primary Examiner*—Gary K. Graham
(74) *Attorney, Agent, or Firm*—Bacon & Thomas, PLLC

(57) ABSTRACT

A sponge mop assembly includes a handle and a head mounted on a bottom end of the handle. The head has a mount clamping a sponge, two front and two rear coupling arms bilaterally extending downward from front and rear sides of the mount such that a space is defined between the mount and the front coupling arms, and two parallel front and two parallel rear squeezing members mounted side by side between the two front and rear coupling arms. A pull rod assembly is mounted on the handle and connected with the sponge for moving the sponge to be squeezed by the squeezing members so as to remove water from the sponge. A brushing member is mounted on a front side of the mount and located in the space. Therefore, the sponge mop assembly is provided with both functions of mopping and brushing the floor as well as being user-friendly.

3 Claims, 6 Drawing Sheets

SPONGE MOP ASSEMBLY

FIELD OF THE INVENTION

The present invention relates generally to a sponge mop, and more particularly to a sponge mop assembly provided with a function of brushing the floor.

BACKGROUND OF THE INVENTION

As shown in FIG. 1, a conventional sponge mop 70 includes a handle 71, a head 72 fastened to a bottom end of the handle 71, and a pull rod assembly pivotally 76 mounted to the handle. The head 72 is composed of a mount 73 clamping a sponge 74, which is bilaterally clamped by two shaft rods 75 and is actuated to move inward between the shaft rods 75 by the pull rod assembly 76 so as to squeeze out water contained in the sponge 74. However, such kind of sponge mop can be used only for mopping the floor instead of any extra functions.

Another conventional mop 80 as shown in FIG. 2 includes the handle 81 curved at a bottom section of the mop 80. The mount 82 of the mop 80 has a front side panel 83 provided with threaded holes 84 therethrough. A brushing member 86 has a mounting panel 87, which has an extensional panel 88 extending outward therefrom and a plurality of ribs 89. The extensional panel 88 has through holes 881 inserted through by screws 91, which are further threadedly engaged with the threaded holes 84, such that the brushing member 86 is fastened on the front side panel 83 of the mount 82. Therefore, the sponge mop 80 can be used not only for mopping the floor but also for brushing the floor by means of the brushing member 86 mounted on the mop 80.

Although the aforesaid conventional mop 80 provided with both functions of mopping and brushing the floor is better than the foregoing conventional mop 70 provided with one function of mopping the floor, it still needs to be improved to be user-friendly. Referring to FIG. 2, the brushing member 86 is fixedly mounted on the front side panel 83 of the mount 82 of the mop 80. In other words, the brushing member 86 is spaced far away from the sponge 99 and remains a distance from the floor while brushing the floor. To make the brushing member 86 contact against the floor with the most effective contact area between the brushing member 86 and the floor, a user has to stoop to brush the floor, as shown in FIG. 3, and lower the handle 81 of the mop 80 for the brushing member 86 contacting against the floor. Meanwhile, the user may easily get exhausted or even hurt his/her waist.

SUMMARY OF THE INVENTION

The primary objective of the present invention is to provide a sponge mop assembly having both functions of mopping and brushing the floor and being user-friendlier than the prior art.

Accordingly, the objective of the present invention is attained by a sponge mop assembly comprising a handle, a head, a pull rod assembly, and a brushing member. The head includes a mount clamping a sponge and mounted to a bottom end of the handle, two front coupling arms extending bilaterally downward from a front side of the mount such that a space is defined between the mount and the front coupling arms, and two rear coupling arms extending bilaterally downward from a rear side of the mount. Two parallel front squeezing members are mounted side by side between the two front coupling arms and two parallel rear squeezing members are mounted side by side between the two rear coupling arms. The pull rod assembly is mounted on the handle and connected with the sponge for moving the sponge to be squeezed by the squeezing members so as to remove water from the sponge. The brushing member is mounted on a front side of the mount and is located in the space. Therefore, the sponge mop assembly of the present invention is provided with both functions of mopping and brushing the floor as well as being user-friendly.

DETAILED DESCRIPTION OF THE INVENTION

Figure 1:
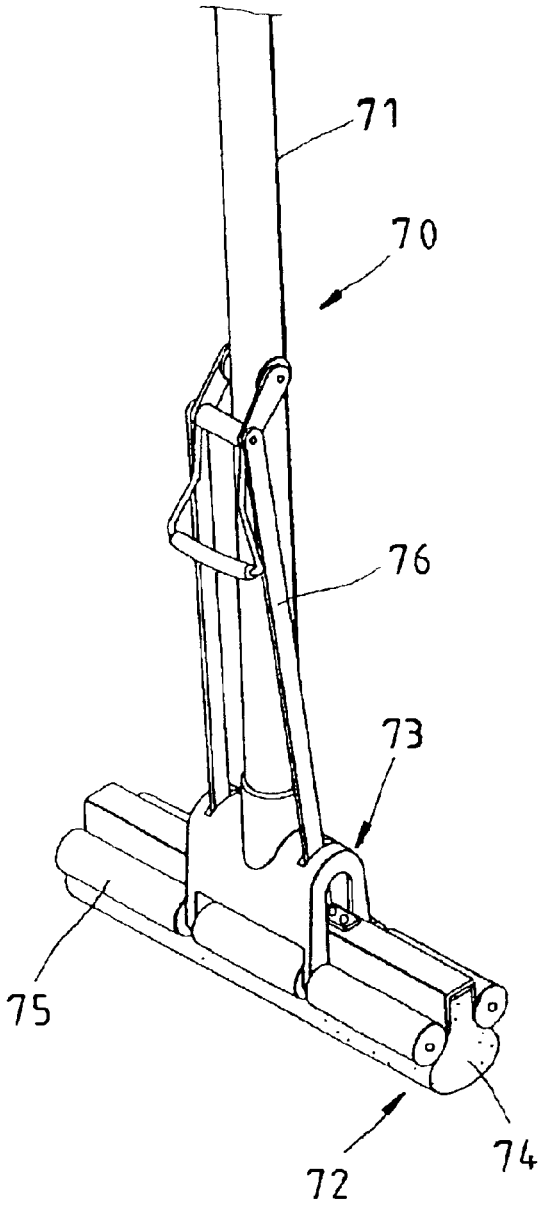
FIG. 1 PRIOR ART
FIG. 1 is a perspective view of a prior art sponge mop.
Figure 2:
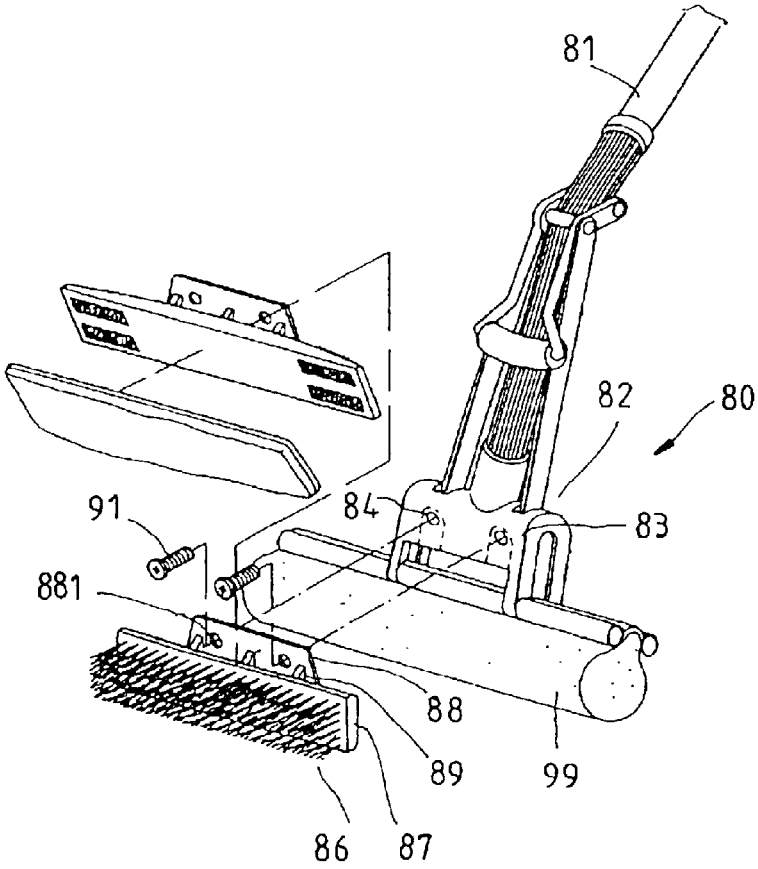
FIG. 2 PRIOR ART
FIG. 2 is an exploded view of another prior art sponge mop.
Figure 3:
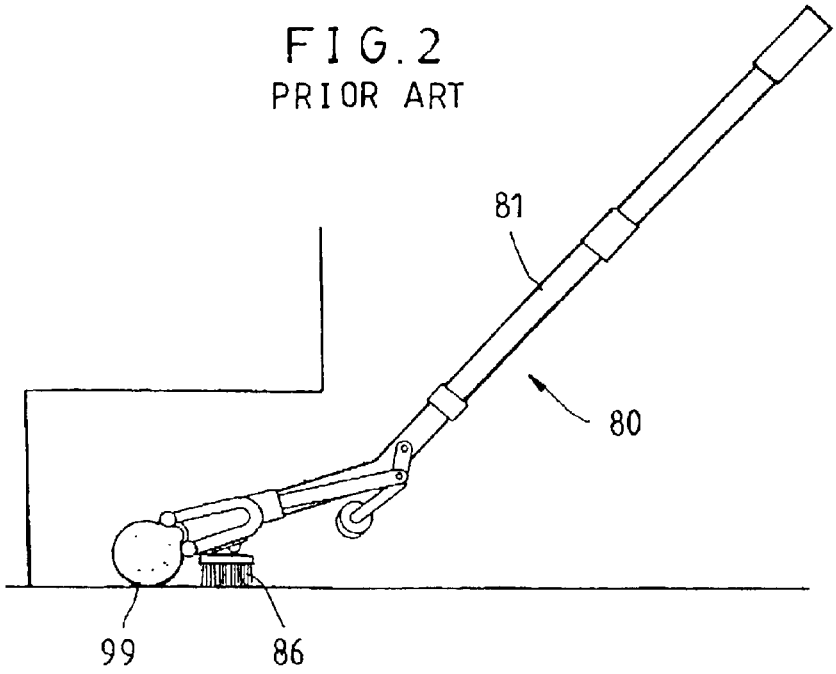
FIG. 3 PRIOR ART
FIG. 3 is schematic view of the prior art sponge mop shown in FIG. 2 at work.
Figure 4:
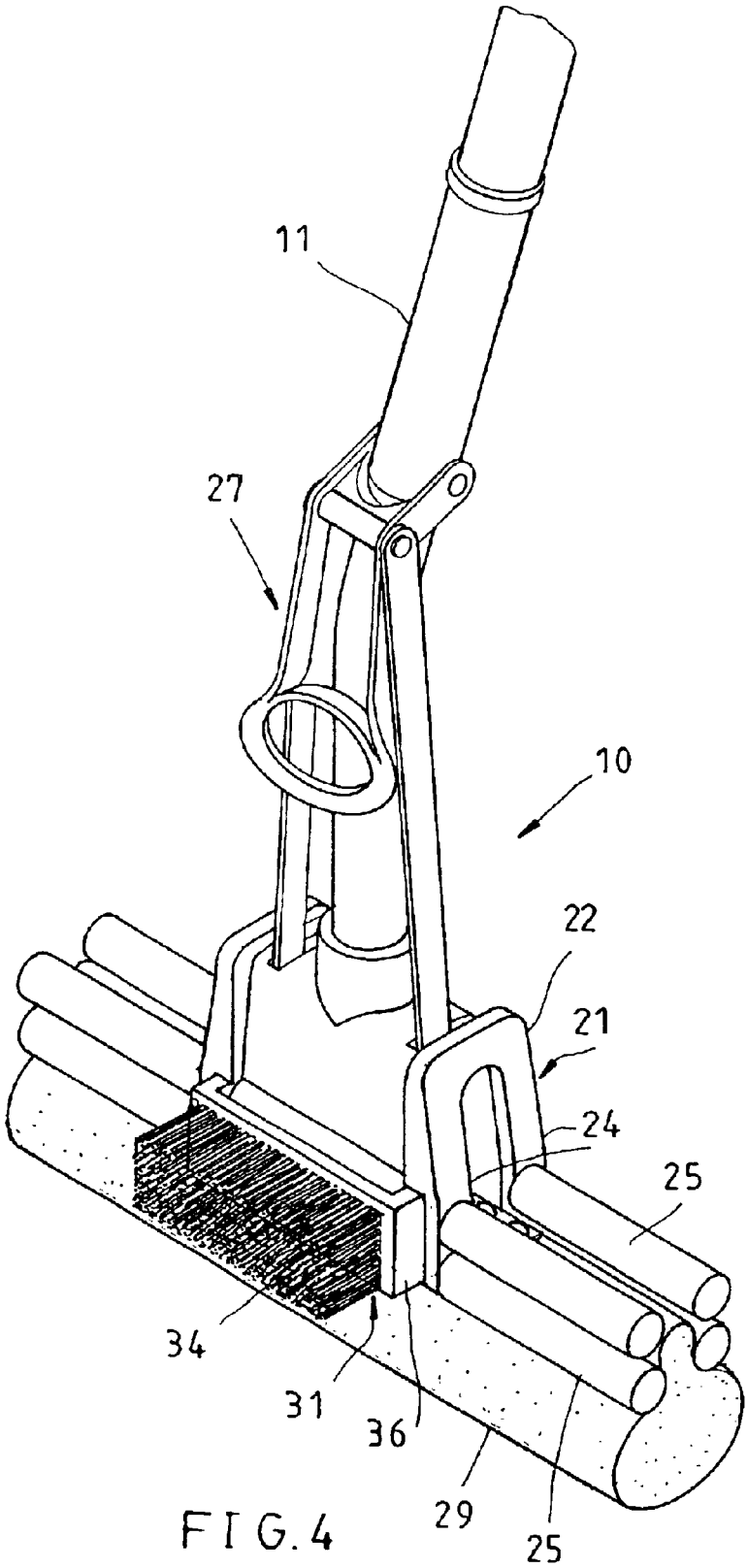
FIG. 4 is a perspective view of a preferred embodiment of the present invention.
Figure 5:
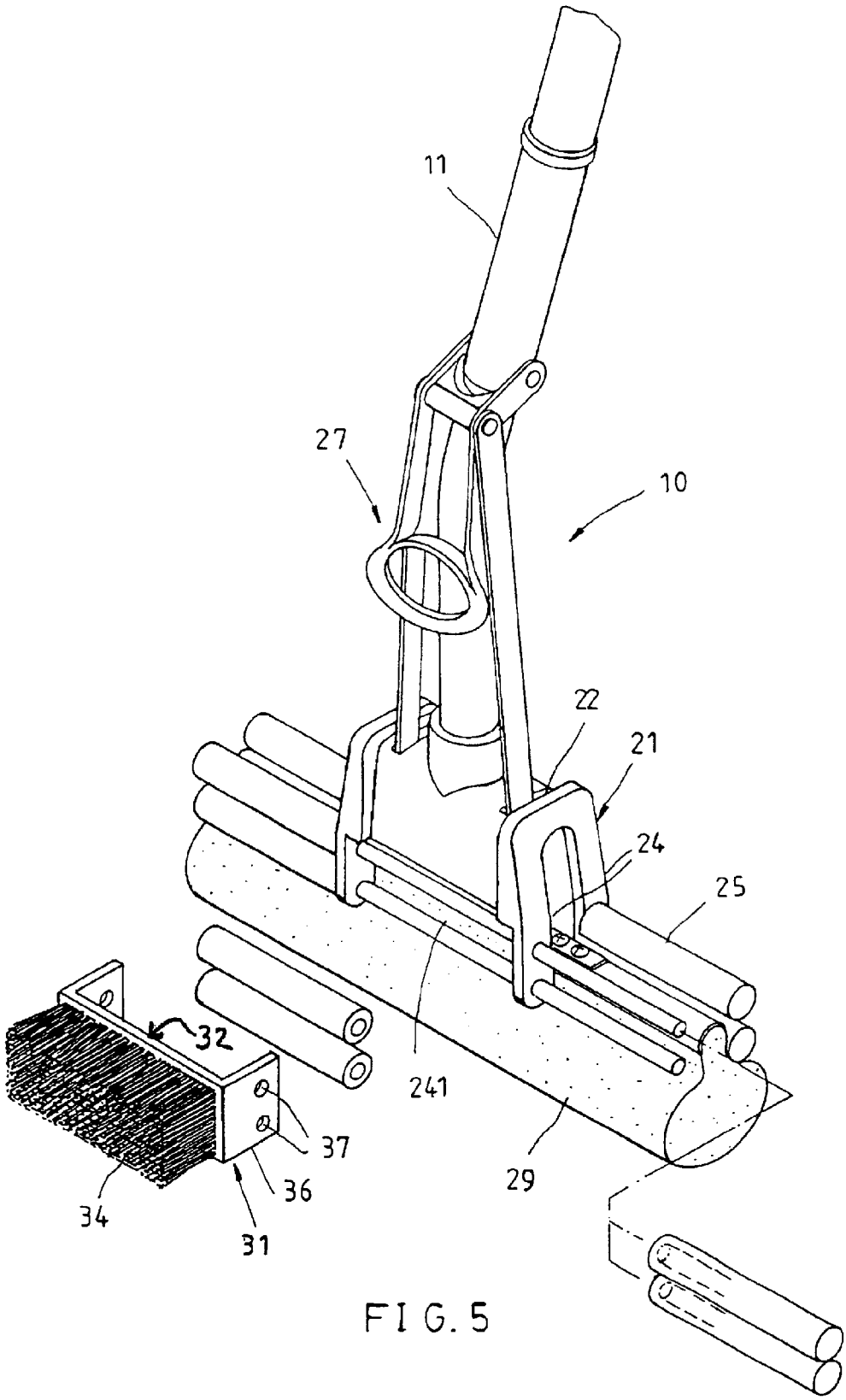
FIG. 5 is an exploded view of the preferred embodiment of the present invention.

Referring to FIGS. 4–5, a sponge mop assembly 10 of a preferred embodiment of the present invention is composed of a handle 11, a head 21, a pull rod assembly 27, and a scrubbing or brushing member 31.

The handle 11 has a predetermined length for operation.

The head 21 includes a mount 22 clamping a sponge 29 and mounted to a bottom end of the handle 11, two front coupling arms 24 bilaterally extending downward from a front side of the mount 22, and two rear coupling arms bilaterally extending from a rear side of the mount 22, such that a space 241 is defined between the front side of the mount 22 and the two front coupling arms 24. Two parallel front squeezing members 25 are mounted side by side between the two front coupling arms 24 and two parallel rear squeezing members 25 are mounted side by side between the two rear coupling arms. The pull rod assembly 27 is pivotally mounted on the handle 11 and is connected with the sponge 29 such that the sponge 29 is actuated by the pull rod assembly 27 to move toward the mount 22 between the squeezing members 25 so as to squeeze out water in the sponge 29.

The present invention is characterized in that the brushing member 31 includes a panel body 32 with an inverted U-shaped cross section and a brush 34. The panel body 32 has a middle section and two side walls 36 each having two through holes 37, which is run through by the two front squeezing members 25 mounted on the front side of the mount 22, such that the brushing member 31 is fixedly mounted on the mount 22. The brush 34 is fixedly mounted on a front side of the middle section of the panel body 32 and extending outwardly.

Figure 6:
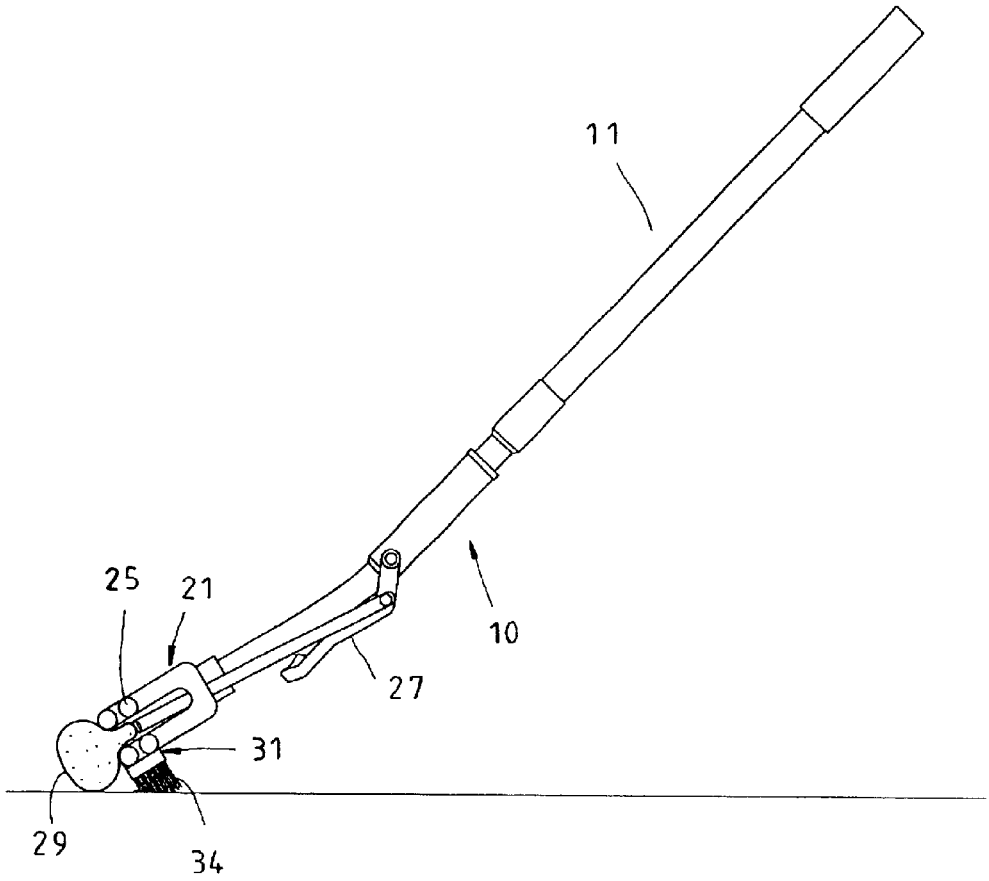
FIG. 6 is a schematic view of the preferred embodiment of the present invention at work.

While in use, the sponge mop assembly 10 of the present invention can not only mop the floor with the sponge 29 but also brush the floor with the brush 34. As shown in FIG. 6, a user can invert the mop 10 with the brushing member 31 facing the floor and slightly lower the handle 11 such that the brush 34 contacts against the floor to brush the floor and it's preferably user-friendly for the user.

Figure 7:
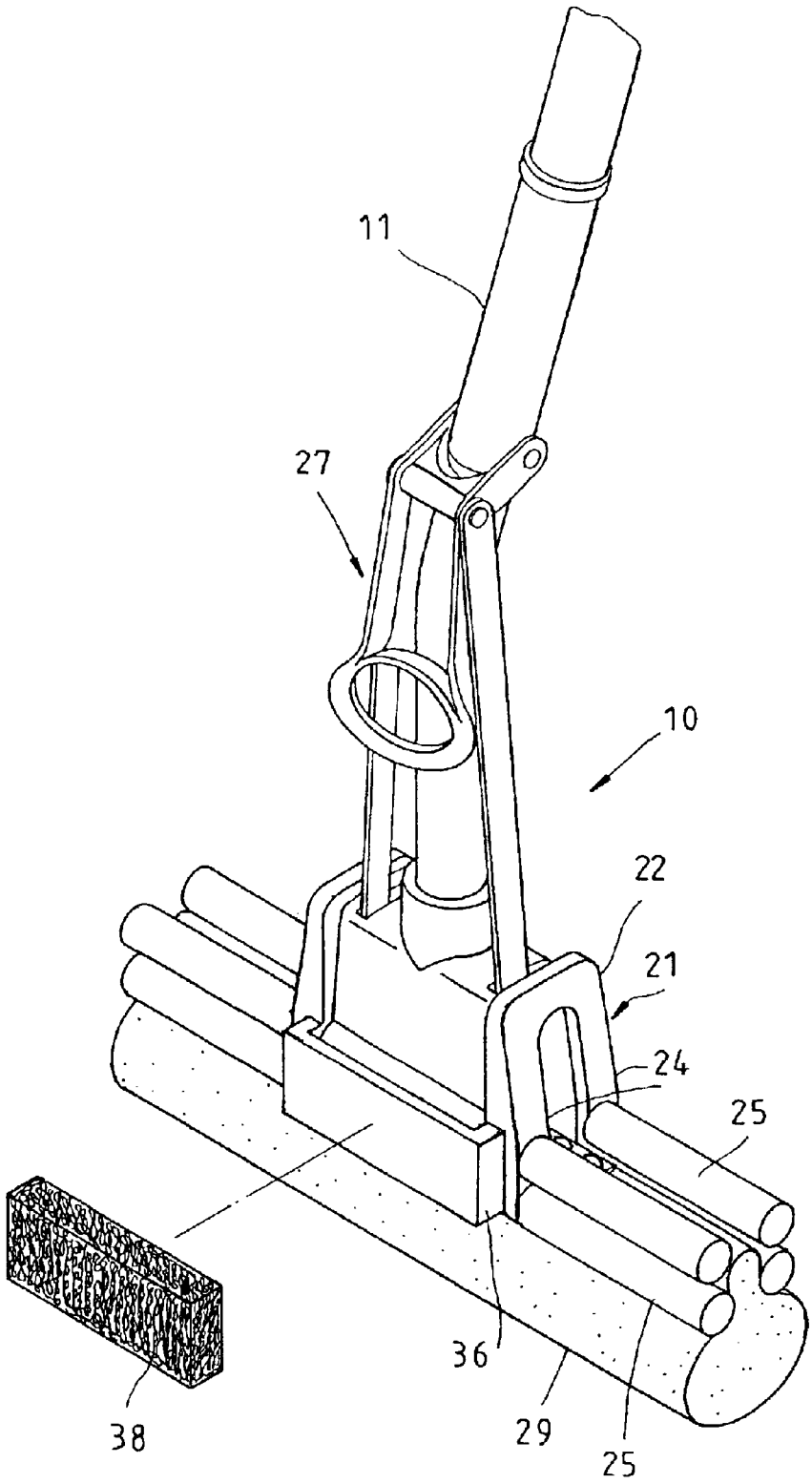
FIG. 7 is a perspective view of another preferred embodiment of the present invention.

Referring to FIG. 7, the brushing member 31 of another preferred embodiment of the present invention includes the panel body 32 and a scouring pad 38 mounted on the front side of the middle section of the panel body 32. The scouring pad 38 is also provided with the function of cleaning the floor.

In conclusion, the present invention is characterized in that the brushing member 31 is mounted on lower ends of the front coupling arms 24 and is in a position extremely approaching the sponge 29. While brushing the floor, it's as easy as lowering the handle 11 a bit such that the brushing member 31 can contact against the floor to do the job.

What is claimed is:

1. A sponge mop assembly, comprising:

a handle;

a head having a mount clamping a sponge and fastened to a bottom end of said handle, two front coupling arms bilaterally extending downward from a front side of said mount such that a space is defined between said front coupling arms and said mount, two parallel front squeezing members mounted side by side between said front coupling arms, two rear coupling arms bilaterally extending downward from a rear side of said mount, and two parallel rear squeezing members mounted side by side between said rear coupling arms;

a pull rod assembly pivotally mounted on said handle and connected with said sponge such that said sponge can be actuated by said pull rod assembly to move inward between said squeezing members so as to remove water from said sponge; and a scrubbing member mounted on the front side of said mount and located in the space between said front coupling arms and said mount, said scrubbing member comprises a U-shaped panel body having a middle section and two side walls respectively extending from two sides of said middle section, each of said two side walls has two through holes for receiving said two front squeezing members therethrough.

2. The sponge mop assembly as defined in claim 1, wherein said scrubbing member comprises a brush mounted on a front side of said middle section of said panel body and extending outwardly away from said mount.

3. The sponge mop assembly as defined in claim 1, wherein said scrubbing member comprises a scouring pad mounted on a front side of said middle section of said panel body.

* * * * *